United States Patent [19]

Giles et al.

[11] Patent Number: 4,545,759

[45] Date of Patent: Oct. 8, 1985

[54] BURNER ATTACHMENT FOR AEROSOL CONTAINER

[75] Inventors: George B. Giles, Scarborough; Donald B. Ross, Markham; Joseph J. McCallion, Toronto; William C. Sherritt, Brampton, all of Canada

[73] Assignee: Giles Tool Agencies Limited, Scarborough, Canada

[21] Appl. No.: 606,126

[22] Filed: May 2, 1984

[30] Foreign Application Priority Data

Feb. 10, 1984 [CA] Canada ..... 447213

[51] Int. Cl.[4] ..... F23D 13/04

[52] U.S. Cl. ..... 431/344; 222/3; 126/40; 137/322

[58] Field of Search ..... 431/142, 143, 344; 137/320, 322; 126/38, 40, 42, 44; 62/45; 222/3; 239/146, 302

[56] References Cited

U.S. PATENT DOCUMENTS

| | | | |
|---|---|---|---|
| 3,140,740 | 7/1964 | Lagried et al. | 126/44 |
| 3,223,139 | 12/1965 | Smith et al. | 431/344 |
| 3,732,060 | 5/1973 | Churchill et al. | 431/344 |
| 3,896,784 | 7/1975 | Baxter | 126/38 |
| 4,082,993 | 4/1978 | Oakes | 431/344 X |
| 4,332,550 | 6/1982 | Baumann | 431/344 |

*Primary Examiner*—Margaret A. Focarino

*Attorney, Agent, or Firm*—Riches, McKenzie & Herbert

[57] ABSTRACT

This invention relates to an improved attachment for a propane/butane fuel container of the aerosol type to provide torches, burners, heaters, lanterns, and the like. In one embodiment the attachment itself includes a torch and control valve, while in other embodiments it is an adaptor to connect conventional or separate devices to the container. The attachment has a cylindrical boss with a central well which screws onto the threaded stem portion of the fuel container to an assembled position in which an actuator pin opens a self-sealing outlet valve in the container. The attachment has a first O-ring seal seated inside the well and a second O-ring seal seated around the inlet boss just below an outwardly extending shoulder. As the assembly is tightened into position on the fuel container, these two O-ring seals are simultaneously compressed, the first against the upper surface of the stem portion and the second against the annular rim of the container. This has the advantage of automatically providing a double seal against leakage of the fuel, as well as transferring some of the structural stress from the stem portion of the container to the stronger annular rim.

11 Claims, 7 Drawing Figures

BURNER ATTACHMENT FOR AEROSOL CONTAINER

BACKGROUND OF THE INVENTION

This invention relates to portable torches, burners, stoves, lanterns and heaters which use fuel from aerosol type containers, and in particular to a novel attachment therefore which provides an improved seal and structural strength.

In the past, it has been well known to provide portable propane torches and burners with refillable containers or "bottles". However, this has the disadvantage that due to the high pressure in the range of about 240–300 psi., the containers are considerably more expensive than the propane they contain.

More recently, attempts have been made to overcome this problem by using butane at lower pressures in disposable aerosol type containers which can be made much more economically. However, this has been found to have the problem that butane does not vaporize very well at lower temperatures, and thus difficulties have been encountered in lighting it when it is cool. The applicant has found that this further problem can be overcome by utilizing a suitable mixture of propane and butane at a pressure of approximately 75 psi. At this reduced pressure, a type Q aerosol container with a pressure relief valve in the bottom may be used safely, but it is desirable that the torch, burner, lamp, etc., be securely attached to the container. There are, of course, two potential problems with this type of detachable connections. The first is leakage of the fuel around the connection, and the second is the possibility of damage to the container as a result of the attachment to the container. This second problem is of particular concern as most conventional connections are made to the inner stem of the container, with the result that a considerable torque can be easily inadvertently applied to the stem through the attachment.

One example of an attempt to overcome these problems is shown in U.S. Pat. No. 3,732,060 to Churchill et al. which issued May 8, 1973 which shows each container attachment with a cap which fits inside a head and a single O-ring seal. An improvement is shown in U.S. Pat. No. 4,082,993 to Oakes which issued Apr. 4, 1978 wherein the attachment is secured to the stem of the container, but a locking ring is provided to transfer some of the stress to the rim of the can. However, this arrangement still has the disadvantages that only a single seal is provided and the user must remember to tighten the locking ring as well as make the initial connection.

SUMMARY OF THE INVENTION

Accordingly, it is an object of the present invention to at least partially overcome the disadvantages of the prior art by providing an improved attachment which provides both a double seat and a double seal with the top of the container.

To this end, in one of its aspects, the invention provides an attachment for a fuel container of the aerosol type, the container having a raised stem portion spaced within an annular rim with an upper surface, the stem portion having a threaded outer surface and a central bore extending from an upper surface to receive an actuator pin to operate a self-sealing outlet valve in the container, the attachment comprising a body with a fuel flow passage extending between a fuel inlet opening and a fuel outlet opening, an actuator pin mounted in the body to actuate the self-sealing outlet valve in the container, the body having a cylindrical inlet boss extending around a central downwardly opening well with an upper surface from which the inlet opening extends, and first resilient seal means located in the well around the inlet opening, the inlet boss having a threaded inner surface which engages the external surface of the stem portion of the container in an assembled position wherein the inlet boss is seated between the raised stem portion and the annular rim portion of the container with the first seal means received between the upper surface of the well and the upper surface of the stem portion of the container and the attachment in bearing contact with the annular rim of the container.

Further objects and advantages of the invention will appear from the following description, taken together with the accompanying drawings.

Figure 1:
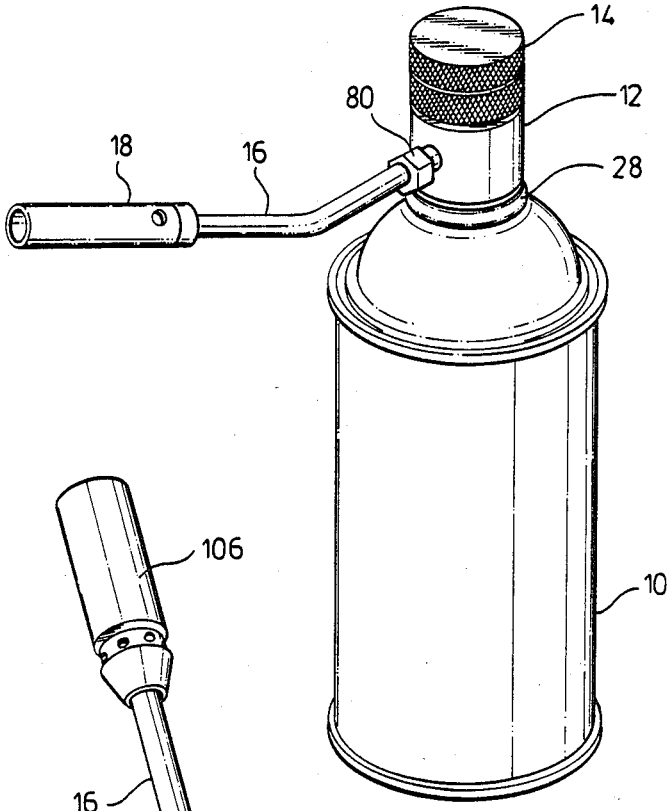
FIG. 1 is an isometric view of a container with an attachment according to a first embodiment of the invention.
Figure 2:
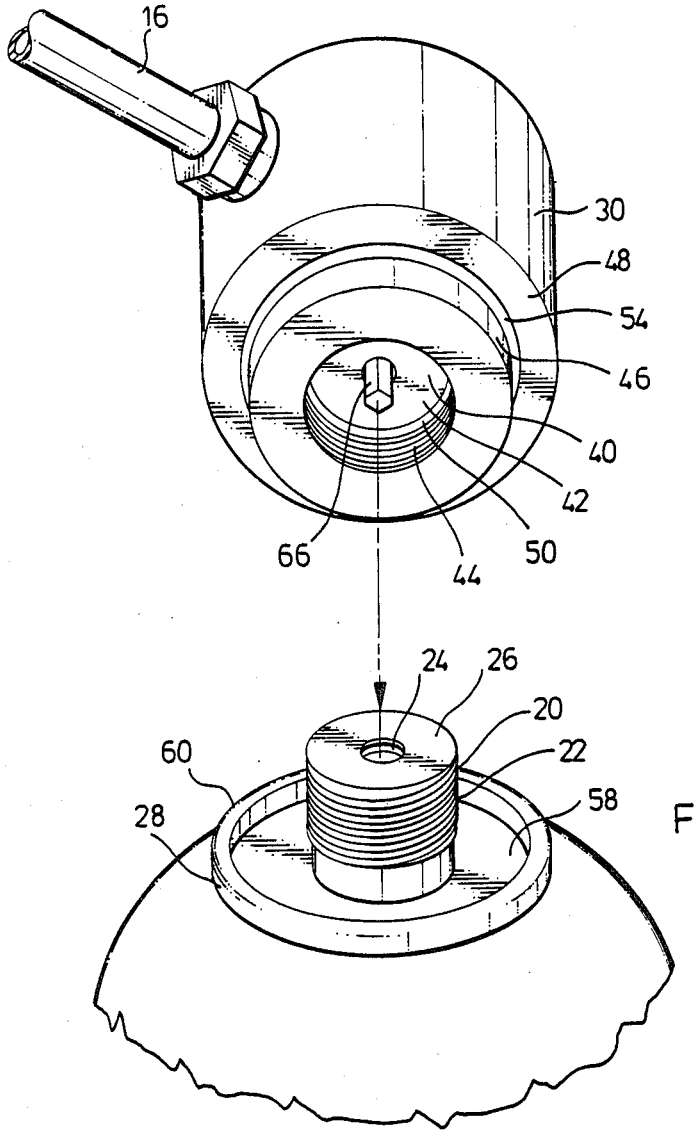
FIG. 2 is an enlarged view showing a portion of the attachment shown in FIG. 1.
Figure 3:
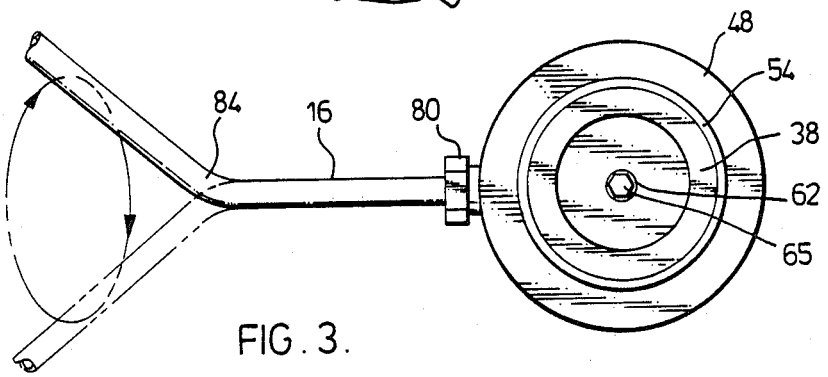
FIG. 3 is a bottom view of the attachment shown in FIG. 1.

Reference is first made to FIG. 1 which shows an aerosol fuel container 10 with a torch attachment 12 with a manual control valve knob 14 and an elongated neck 16 leading to the torch 18 itself. In this embodiment, the container 10 is a type Q aerosol container with a pressure relief valve (not shown) in the bottom for additional safety. As may clearly be seen in FIGS. 2–4, the upper end of the container 10 has a central stem portion 20 with a threaded outer surface 22 and a central bore 24 extending downwardly from an upper surface 26 to a conventional self-sealing outlet valve (not shown) in the container 10. The stem portion 20 is surrounded by an upwardly projecting double walled rim 28 which is formed in a conventional manner when the stem and valve arrangement are inserted into the outer wall of the container 10 during manufacture.

Figure 4:
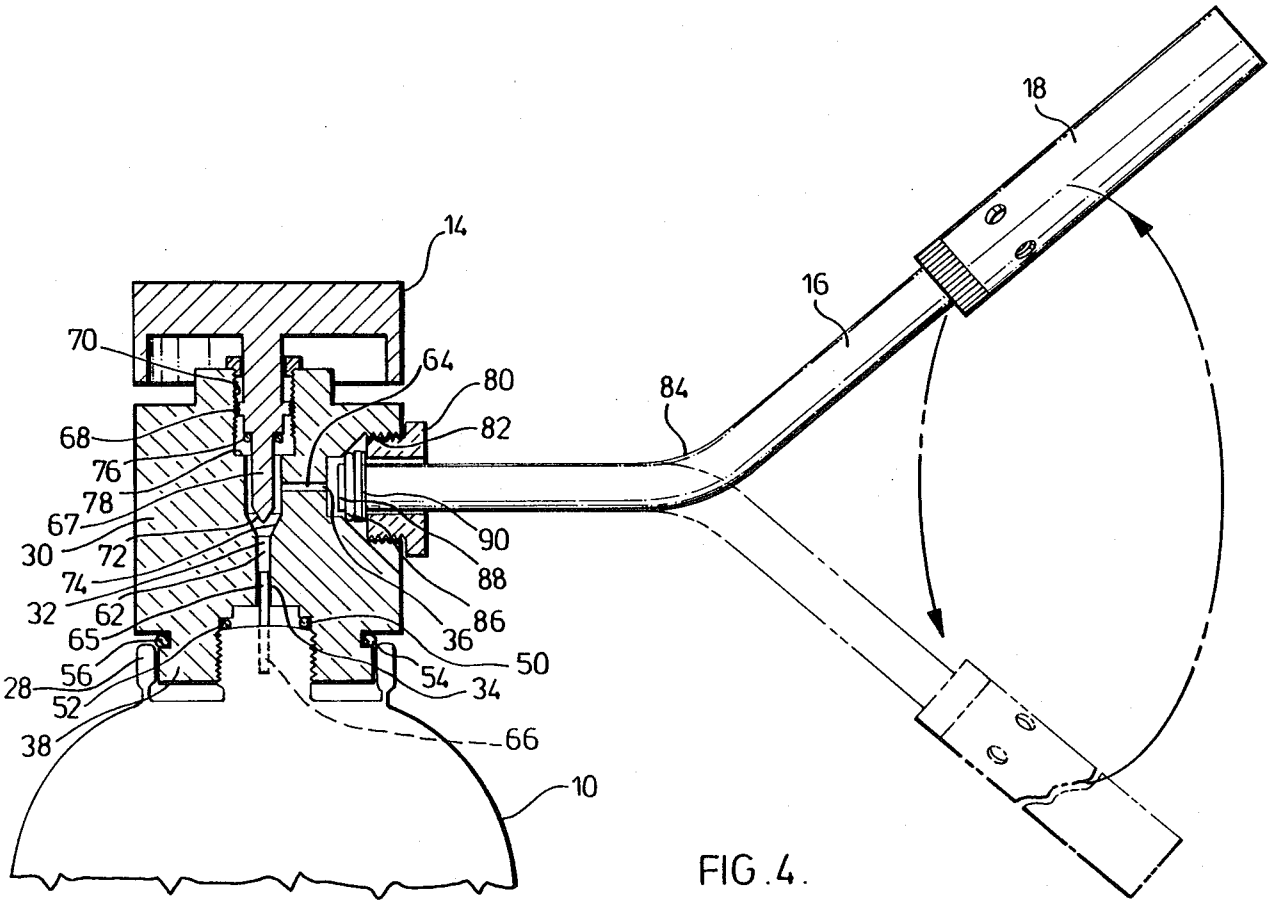
FIG. 4 is a partial sectional view of the attachment shown in FIG. 1.

As best seen in FIG. 4, the torch attachment has a body 30 with a fuel flow passage 32 extending from an inlet opening 34 to an outlet opening 36. The body 30 has a cylindrical inlet boss 38 with a downwardly open central well 40 with an upper surface 42 from which the inlet opening 34 extends. The inlet boss 38 has a threaded inner surface 44 and a cylindrical outer wall 46 which terminates at an outwardly extending shoulder 48. A first resilient O-ring seal 50 is located adjacent a shoulder 52 on the upper surface 42 of the well 40 and a second resilient O-ring seal 54 is located in a retaining groove 56 in the outer wall 46 adjacent the outwardly extending shoulder 48. As may be seen, the inlet boss 38 screws onto the stem portion 20 of the container to an assembled position in which it fits down into a space 58 between the stem portion 20 and the rim 28. In this position the first O-ring seal 50 is compressed between the upper surface 26 of the stem portion 20 and the upper surface 42 of the well 40, and the second O-ring seal 54 is compressed between the upper surface 60 of the annular rim 28 and the horizontal shoulder 48.

The fuel flow passage 32 through the body includes a vertical bore 62 which extends upwardly from the inlet opening and intersects a bore 64 extending horizontally from the outlet opening 36. An actuating pin 65 having a hexagonal cross-section is fixed in the vertical bore 62 with its lower end 66 projecting into the central bore 24 of the stem portion 20 to actuate the self-sealing outlet valve in the container 10. As may be seen, a control valve 67 is seated in the body 30 to accurately control the flow of fuel through the passage 32. The control valve 67 has an enlarged threaded portion 68 which engages a corresponding threaded surface 70 of the body to seat the tip end 72 of the valve 67 in a seat 74 in the vertical bore 62. The valve 67 is also provided with an O-ring seal 76 which abuts against shoulder 78 to ensure shut-off in the closed position. The elongated neck 16 leading to the torch 18 is swivel mounted on the body 30 by a threaded bushing 80 which is screwed into a hole 82 leading to the outlet opening 36. The elongated neck 16 is formed of a hollow tube with an obtuse bend 84 in it, and has another O-ring seal 86 retained between a flared end 88 and a lock washer 90 with a lock ring to provide full 360° swivel movement. The torch 18 has a conventional structure for a torch of the propane/butane type and need not be described further.

In use, the container 10 is filled with a mixture of propane and butane to a predetermined pressure and sealed in a conventional manner. In this embodiment, there is normally a greater proportion of butane than propane and it is at a pressure of approximately 75 psi., but it is apparent that other proportions or even other suitable fuels may be used for other applications. The torch attachment 12 is then screwed tightly onto the top of the container with the control valve knob 14 in the off position. As described above, in this position the first O-ring seal 50 is compressed between the upper surface 26 of the stem portion 20 of the container and the upper surface 42 of the well 40 to provide a first seal against leakage of the fuel. At the same time, the second O-ring seal 50 is compressed between horizontal shoulder 48 and the annular rim 28 which, in addition to providing a second seal against leakage, also provides considerable structural support. Thus, while the torch attachment is connected to the container 10 by the central stem portion 20, the support of the body 30 by the rim 28 has the effect of transferring a portion of any torque applied to the torch attachment from the relatively weak stem portion 20 to the stronger rim 28. Furthermore, this occurs automatically when the torch attachment is connected to the container without requiring a second step which may or may not be overlooked. If an even stronger assembly is required, the outer wall 46 of the cylindrical boss 38 may be made to provide a friction fit with the annular rim 28. When the torch attachment 12 is screwed down onto the container, the lower end 66 of the actuating pin contacts the self-sealing outlet valve in the container 10 and opens it to provide a supply of pressurized fuel to the inlet opening 34 of the body 30. The control valve 67 is then opened by manually turning the knob 14 counterclockwise, and the fuel flows upwardly through the cylindrical vertical bore 62 of the fuel passage 32 around the outside of the hexagonal shaped actuating pin 65. The torch is then lit and operated in a conventional manner. The fact that the neck 16 is bent and is swivel mounted on the body 30 allows the flame from the torch 18 to be directed in a downward direction if necessary without tilting the container 10 past horizontal.

Figure 5:
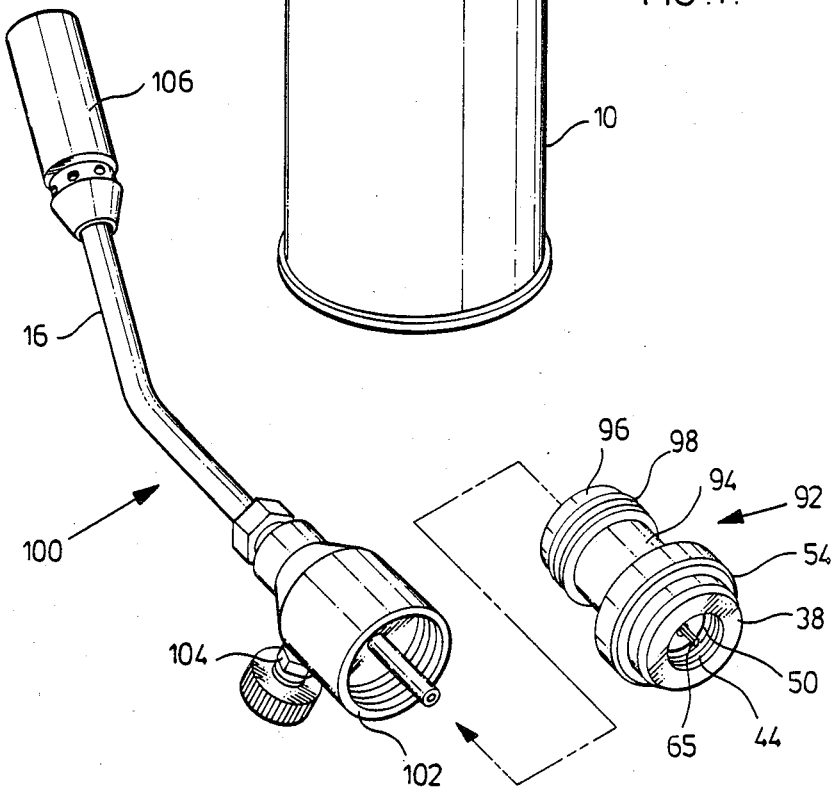
FIG. 5 (located on page with FIG. 1) is an isometric view showing an attachment according to a second embodiment of the invention, together with a conventional torch and control valve arrangement.
Figure 6:
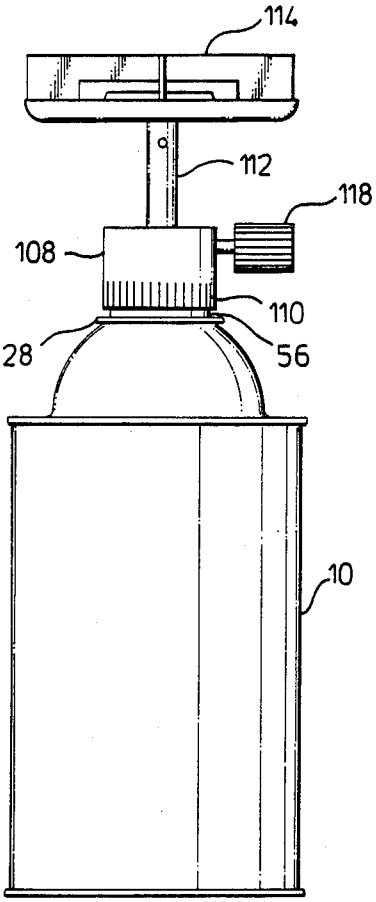
FIG. 6 shows another embodiment of the invention connecting a stove burner to a fuel container.
Figure 7:
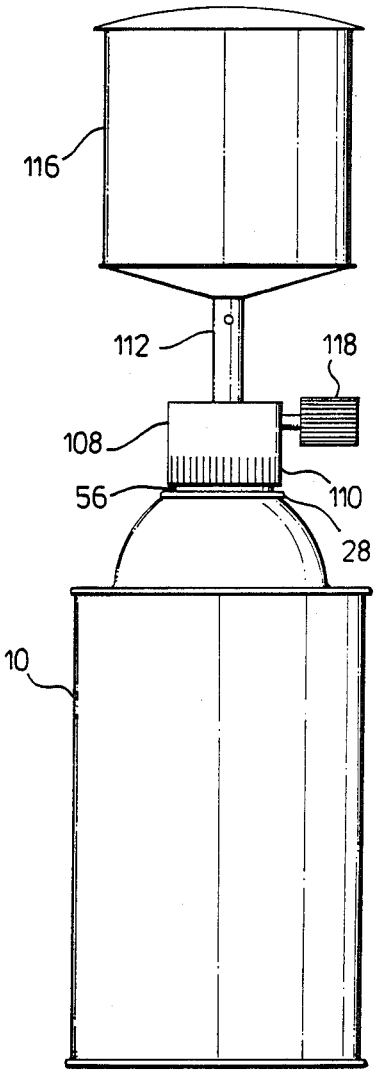
FIG. 7 is a similar view showing a lantern connected to a fuel container.

FIGS. 5, 6 and 7 show alternate embodiments of the invention wherein the attachment is an adaptor for connecting various other attachments to the fuel container. As many of the features are identical to those of the first embodiment described above, elements common to the first embodiment are illustrated using the same reference numerals and the description of their structure and use is not repeated in detail. FIG. 5 shows the adaptor 92 with a body 94 having an inlet boss 38, and first and second O-ring seals 50,54 as described above. However, in this embodiment, the adaptor 92 does not have a control valve and the fuel flow passage extends straight through the body 94 to an outlet portion 96 having a threaded outer surface 98. This adaptor 92 is used to connect a separate conventional torch and control valve assembly 100 to a fuel container 10. In view of the fact that this is a straight through adaptor with no control valve, the actuating pin 65 must be floating rather than fixed in the body 94 to avoid the escape of fuel if the adaptor 92 is screwed onto the container 10 without the torch and control valve assembly 100. Thus, when the torch and control valve assembly 100 is attached to the adaptor, it depresses the floating actuating pin which, in turn, opens the self-sealing outlet valve in the container 10. However, if the torch and control valve assembly 100 is not attached, the actuating pin is free to float upwards with the pressure of the fuel to close the valve.

In use, the threaded outer surface 98 of the outlet portion 96 is screwed into a threaded collar 102 of the torch and control valve assembly 100, and the control valve 104 is turned to the off position. The other end of the adaptor 92 is then screwed onto a fuel container 10, as described above. The control valve 104 is then opened to light and operate the torch 106 in a conventional manner. Thus, this adaptor 92 provides the improved connection to the fuel container 10 that is described above for existing torch and control valve assemblies 100 of a conventional type.

The same embodiment of the invention is shown in both FIGS. 6 and 7, but the illustrated uses are different. The adaptor 108 has a body 110 with an inlet boss, actuating pin and first and second O-ring seals which are not shown, but are identical to that described above so that the connection of the adaptor 108 to the fuel container 10 is the same. However, in this case, the fuel flow passage extends through the body 110 to an outlet opening from which a vertically extending tube 112 connects to a stove burner 114 in FIG. 6 and a lantern 116 in FIG. 7. The adaptor 108 also has a control valve which is manually operated by knob 118 to control the flow of fuel through the adaptor to the stove burner or lantern, as the case may be.

Although the description of this invention has been given with respect to particular embodiments, it is not to be construed in a limiting sense. Variations and modifications will now occur to those skilled in the art. For instance, it is apparent that other types of fuels may be used and the attachment or adaptor according to the invention may be used to connect the fuel container to other variations of torches, burners and lanterns and for other devices such as heaters and dryers. For a definition of the invention, reference is made to the appended claims.

What we claim is:

1. An attachment for a fuel container of the aerosol type, the container having a raised stem portion spaced within an annular rim with an upper surface, stem portion having a threaded outer surface and a central bore extending from an upper surface to receive an actuator pin to operate a self-sealing outlet valve in the container, the attachment comprising a body with a fuel flow passage extending between an integral fuel inlet opening and a fuel outlet opening, an actuator pin mounted in the body to actuate the self-sealing outlet valve in the container, the body having a cylindrical inlet boss extending around a central downwardly opening well with an upper surface from which the inlet opening extends and an outer wall which terminates at an outwardly extending shoulder, first resilient seal means located in the well around the inlet opening, and second resilient seal means extending around the inlet boss, the inlet boss having a threaded inner surface which engages the threaded external surface of the stem portion of the container in an assembled position wherein the inlet boss is seated between the raised stem portion and the annular rim portion of the container, whereby as the attachment is screwed onto the container in the assembled position a double seal against leakage and structural support is provided by the simultaneous engagement of the first seal means between the upper surface of the well and the upper surface of the stem portion of the container and the second seal means between the upper surface of the annular rim of the container and the outwardly extending shoulder.

2. An attachment as claimed in claim 1 wherein the outer wall of the inlet boss is in contact with the annular rim of the container.

3. An attachment as claimed in claim 1 wherein the fuel container is adapted to hold a mixture of substantial portions of propane and butane.

4. An attachment as claimed in claim 3 further including torch means mounted on the body in connection with the fuel outlet opening, and a control valve having manual control means mounted to control the flow of fuel through the fuel flow passage to the torch means.

5. An attachment as claimed in claim 4 wherein the torch means has an elongated neck bent at an obtuse angle, and the torch means is swivel mounted on the body.

6. An attachment as claimed in claim 3 wherein the actuator pin has a hexagonal cross-section and is received in a cylindrical bore in the body to provide a portion of the fuel flow passage therebetween.

7. An attachment as claimed in claim 3 wherein the attachment is an adaptor wherein the body has an outlet portion with a threaded outer surface to engagingly receive a conventional elongated torch and control valve assembly whereby fuel from the container flows through the adaptor to the torch and is controlled by the control valve.

8. An attachment as claimed in claim 3 wherein the attachment is an adaptor which includes a control valve having manual control means, and wherein the body has outlet connection means for receiving a portable stove attachment, whereby fuel from the container flows through the adaptor to the stove attachment and is controlled by the control means.

9. An attachment as claimed in claim 3 wherein the attachment is an adaptor which includes a control valve having manual control means, and wherein the body has outlet connection means for receiving a portable heater attachment, whereby fuel from the container flows through the adaptor to the heater attachment and is controlled by the control means.

10. An attachment as claimed in claim 3 wherein the attachment is an adaptor which includes a control valve having manual control means, and wherein the body has outlet connection means for receiving a portable lantern attachment, whereby fuel from the container flows through the adaptor to the lantern attachment and is controlled by the control means.

11. An attachment as claimed in claim 3 wherein the first and second seal means are O-rings.

* * * * *